US005697348A

United States Patent [19]

Schwager

[11] Patent Number: 5,697,348

[45] Date of Patent: Dec. 16, 1997

[54] VAPOR MANAGEMENT SYSTEM

[75] Inventor: Bryce Andrew Schwager, Ypsilanti, Mich.

[73] Assignee: Ford Global Technologies, Inc., Dearborn, Mich.

[21] Appl. No.: 668,175

[22] Filed: Jun. 21, 1996

[51] Int. Cl.[6] ..... F02M 37/04

[52] U.S. Cl. ..... 123/520; 123/516

[58] Field of Search ..... 123/516, 520, 123/521, 518, 519

[56] References Cited

U.S. PATENT DOCUMENTS

| | | | |
|---|---|---|---|
| 4,308,840 | 1/1982 | Hiramatsu et al. . | |
| 4,338,106 | 7/1982 | Mizuno et al. . | |
| 4,815,436 | 3/1989 | Sasaki | 123/520 |
| 4,894,072 | 1/1990 | Turner et al. . | |
| 5,111,795 | 5/1992 | Thompson . | |
| 5,143,041 | 9/1992 | Franzke . | |
| 5,165,379 | 11/1992 | Thompson . | |
| 5,337,721 | 8/1994 | Kasuya | 123/519 |
| 5,347,971 | 9/1994 | Kobayashi | 123/520 |
| 5,398,660 | 3/1995 | Koyama et al. . | |
| 5,456,236 | 10/1995 | Wakashiro | 123/519 |
| 5,456,237 | 10/1995 | Yamazaki et al. . | |
| 5,460,136 | 10/1995 | Yamazaki et al. . | |
| 5,479,904 | 1/1996 | Fujimori et al. . | |

FOREIGN PATENT DOCUMENTS

| | | | |
|---|---|---|---|
| 0023348 | 2/1980 | Japan | 123/520 |

*Primary Examiner*—Carl S. Miller
*Attorney, Agent, or Firm*—Mark S. Sparschu

[57] ABSTRACT

In one embodiment of the present invention, a vapor management system for the fuel system of a motor vehicle includes two carbon canisters for the capturing of fuel vapor from the vehicle's fuel tank. A fuel vapor control valve allows loading of the fuel vapor into the canisters in series and subsequent purging in parallel to the air intake of the vehicle's engine.

5 Claims, 2 Drawing Sheets

VAPOR MANAGEMENT SYSTEM

BACKGROUND OF THE INVENTION

1. Field of the Invention

The present invention relates to vapor management systems. A preferred embodiment of the present invention relates to fuel vapor management systems for motor vehicles.

2. Description of the Related Art

In the control of evaporative hydrocarbon emissions from motor vehicles, one or more carbon canisters are often employed. During conditions under which vapor pressure builds up in the fuel tank of the vehicle, an air and fuel vapor mixture flows out of the fuel tank and through the one or more canisters. The canisters store the fuel vapor, allowing only pure air to escape. During subsequent "purge" cycles, the engine control computer of the vehicle opens a purge control valve, which allows air to be drawn through the carbon canisters. The fuel vapor stored in the canisters is drawn by engine vacuum into the air intake of the engine, where the vapor is burned.

Some evaporative emission control systems employ two carbon canisters coupled in series in order to more effectively store, or "load", fuel vapor. The canisters being in series, the air and fuel vapor mixture from the fuel tank passes through one canister and then through the other.

Although a series configuration of carbon canisters can improve the efficiency of loading the canisters with fuel vapor, a drawback of such a configuration can also exist. When purging of the fuel vapor in the canisters is performed, the series configuration of canisters presents a relatively high restriction to the engine vacuum which is attempting to draw air through them. This excessive restriction may result in excessive vacuum being developed in the fuel tank itself, because the inlet to the first carbon canister is coupled to the fuel tank as well as to the purge control valve. The excessive vacuum can lower the boiling point of the fuel in the tank, causing additional fuel vapor which must be dealt with. Also, the reduced-boiling-point fuel may cavitate when drawn into the vehicle's fuel pump, leading to fuel vapor in the vehicle's fuel lines.

A fuel vapor management system which can provide the high vapor-loading effectiveness of series-loaded carbon canisters while reducing the disadvantages caused by the relatively high restriction presented by series-purged carbon canisters can provide advantages over the prior art.

SUMMARY OF THE INVENTION

The present invention provides a fuel vapor control valve assembly. The valve assembly comprises a first chamber having a first opening to the exterior of the valve assembly, a second chamber having a second opening to the exterior of the valve assembly, a third chamber having a third opening to the exterior of the valve assembly, and a fourth chamber having at least a fourth opening to the exterior of the valve assembly. The valve assembly further includes a first one-way valve, the first one-way valve disposed between said first and second chambers and oriented to allow vapor flow from the first chamber to the second chamber but not from the second chamber to the first chamber. The valve assembly additionally comprises a second one-way valve, the second one-way valve disposed between the first and second chambers and oriented to allow vapor flow from the second chamber to the first chamber but not from the first chamber to the second chamber. In additions, the valve assembly contains a third one-way valve, the third one-way valve disposed between the first and third chambers and oriented to allow vapor flow from the third chamber to the first chamber but not from the first chamber to the third chamber. Further, the valve assembly comprises a fourth one-way valve, the fourth one-way valve disposed between the third chamber and the exterior of the valve assembly and oriented to allow vapor flow from the third chamber to the exterior of the valve assembly but not from the exterior of the valve assembly to the third chamber. Also, the valve assembly includes a fifth one-way valve, the fifth one-way valve disposed between the fourth chamber and the exterior of the valve assembly and oriented to allow vapor flow from the exterior of the valve assembly to the fourth chamber but not from the fourth chamber to the exterior of the valve assembly.

The present invention also provides a fuel vapor control system. The fuel vapor control system comprises a first fuel-vapor-capturing canister having first and second ports and a second fuel-vapor-capturing canister having third and fourth ports. The system also includes a vapor control valve further comprising: first, second, third and fourth chambers; a first one-way valve, the first one-way valve disposed between the first and second chambers and oriented to allow vapor flow from the first chamber to the second chamber but not from the second chamber to the first chamber; a second one-way valve, the second one-way valve disposed between the first and second chambers and oriented to allow vapor flow from the second chamber to the first chamber but not from the first chamber to the second chamber; a third one-way valve, the third one-way valve disposed between the first and third chambers and oriented to allow vapor flow from the third chamber to the first chamber but not from the first chamber to said third chamber; a fourth one-way valve, the fourth one-way valve disposed between the third chamber and the exterior of the valve assembly and oriented to allow vapor flow from the third chamber to the exterior of the valve assembly but not from the exterior of the valve assembly to the third chamber; and a fifth one-way valve, the fifth one-way valve disposed between the fourth chamber and the exterior of the valve assembly and oriented to allow vapor flow from the exterior of said the assembly to said fourth chamber but not from the fourth chamber to said exterior of the valve assembly. The fuel vapor control system also includes a fuel tank having an interior volume, the interior volume fluidically coupled to the first chamber. Also, the system contains a vacuum source and a purge valve fluidically coupled between the first chamber and the vacuum source. In the system, the second chamber is fluidically coupled to the first port of the first fuel-vapor-capturing canister, the third chamber is fluidically coupled to the first port of the second fuel-vapor-capturing canister, and the fourth chamber is fluidically coupled to the second port of the first fuel-vapor-capturing canister and to the second port of the second fuel-vapor-capturing canister.

Systems according to the present invention can provide the high vapor-loading effectiveness of series-loaded carbon canisters while reducing the disadvantages caused by the relatively high restriction presented by series-purged carbon canisters. The present invention can thus provide substantial benefits over the prior art.

DETAILED DESCRIPTION OF THE PREFERRED EMBODIMENT

Figure 1:
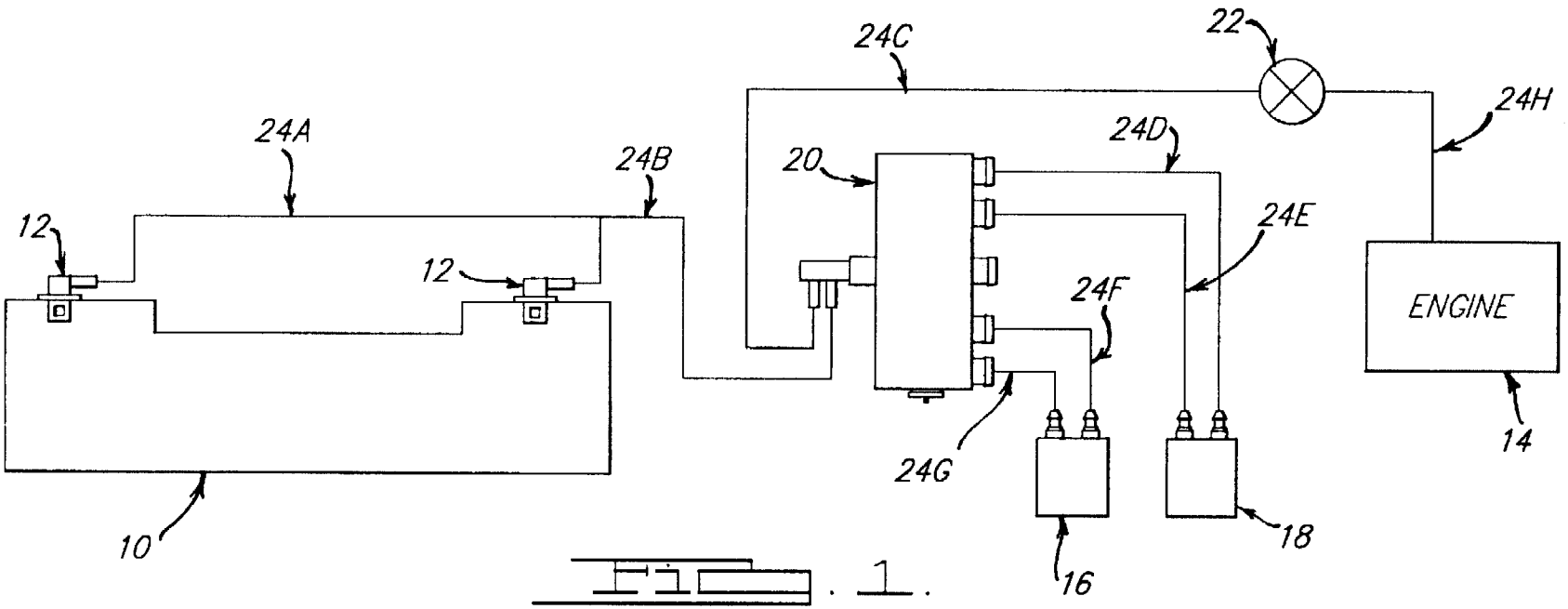
FIG. 1 is a fuel vapor management system according to one embodiment of the present invention.

Referring first to FIG. 1, a fuel vapor management system for a motor vehicle is illustrated. The system includes a fuel tank 10. Fuel tank 10 includes one or more vent openings, each preferably having a valve 12. The vent openings and valves 12 allow appropriate venting of fuel vapor, but not liquid fuel, from fuel tank 10. The use of such valves 12 is well-known to those skilled in the art of motor vehicle fuel systems.

The system also includes the vehicle's engine 14. Additionally, the system includes two carbon canisters 16 and 18. Carbon canisters 16 and 18 are used to store fuel vapor which leaves fuel tank 10 through the vent openings. A fuel vapor control valve 20 is coupled between fuel tank 10 and carbon canisters 16 and 18. Fuel vapor control valve 20 is also coupled between carbon canisters 16 and 18 and a purge regulation valve 22. Purge regulation valve 22 is preferably a solenoid valve opened and closed under command of an engine control computer (not shown). Vapor lines 24A–24G connect the various components illustrated in FIG. 1. In particular, vapor line 24H couples purge regulation valve 22 to a source of vacuum at the air intake to engine 14, such as the intake manifold or throttle body of engine 14.

Figure 2:
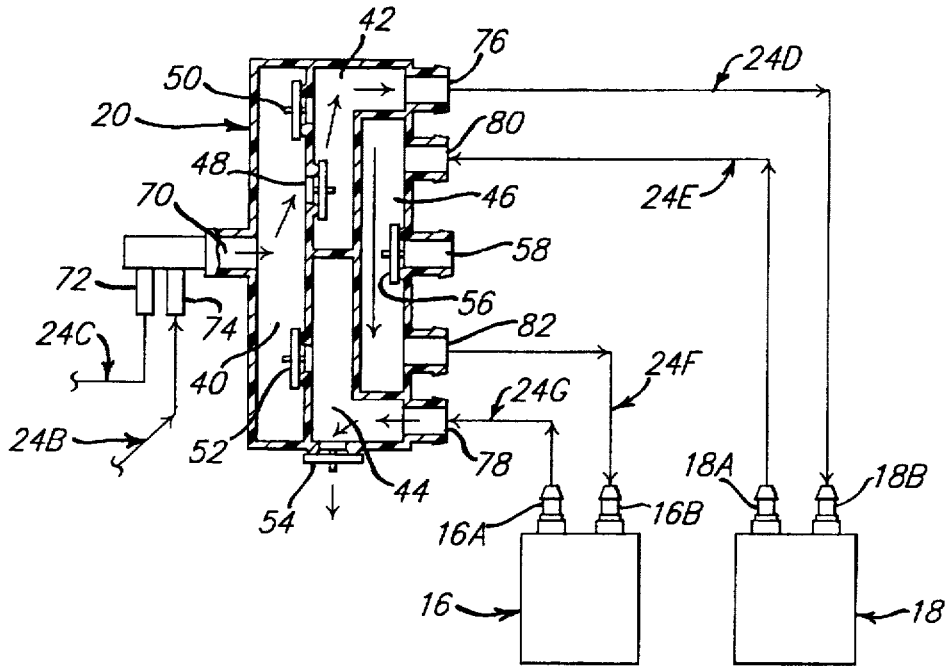
FIG. 2 shows a portion of the system of FIG. 1, illustrating the internal structure of fuel vapor control valve 20 and also illustrating the flow of air and fuel vapor while canisters 16 and 18 are loaded.

Refer now additionally to FIG. 2. FIG. 2 shows fuel vapor control valve 20 in cross-section. Fuel vapor control valve 20 includes a first chamber 40, a second chamber 42, a third chamber 44 and a fourth chamber 46. A first check valve 48 is disposed between first chamber 40 and second chamber 42. Check valve 48 is oriented to allow flow of fuel vapor and air only from first chamber 40 to second chamber 42. Check valve 48 opens to allow flow of fuel vapor and air from first chamber 40 to second chamber 42 if an appropriate positive pressure difference exists between first chamber 40 and second chamber 42.

A second check valve 50 is also disposed between first chamber 40 and second chamber 42. Check valve 50 is oriented to allow flow of fuel vapor and air only from second chamber 42 to first chamber 40. A third check valve 52 is located between first chamber 40 and third chamber 44. Check valve 52 is oriented to allow flow of fuel vapor and air from third chamber 44 to first chamber 40, but not to allow flow of fuel vapor and air from first chamber 40 to third chamber 44. A fourth check valve 54 is disposed between third chamber 44 and the exterior of fuel vapor control valve 20. Check valve 54 is oriented to allow air to flow from third chamber 44 to the exterior of fuel control valve 20, but not from the exterior of fuel control valve 20 to third chamber 44. A fifth check valve 56 is disposed between fourth chamber 46 and the exterior of fuel control valve 20 via an atmospheric inlet 58. Check valve 56 is oriented to allow air to flow from the exterior of fuel control valve 20 to fourth chamber 46, but not from fourth chamber 46 to the exterior of fuel control valve 20. A hose may be coupled to atmospheric inlet 58 in the event that a remote source of fresh air is desired.

First chamber 40 of fuel vapor control valve 20 has an opening 70 having two ports 72 and 74. Opening 70 is preferably continually open, in the sense that fuel vapor control valve 20 has no valve controlling the flow of air or vapor through opening 70. Second chamber 42 has an opening 76, preferably continually open. Third chamber 44 has an opening 78, also preferably continually open. Fourth chamber 46 has openings 80 and 82, also preferably continually open.

FIG. 2 also illustrates the path followed by the air and fuel vapor mixture from fuel tank 10 when carbon canisters 16 and 18 are loaded. Such loading occurs when purge control valve 22 is not open and the vapor pressure in fuel tank 10 rises above a predetermined level. Via port 74, the air and fuel vapor mixture enters first chamber 40 of fuel vapor control valve 20. The air and fuel vapor mixture then passes through check valve 48 into second chamber 42. The air and fuel vapor mixture then proceeds through opening 76 and vapor line 24D into carbon canister 18. The air and fuel vapor mixture (with less fuel vapor because carbon canister 18 absorbed some fuel vapor) then leaves carbon canister 18 and passes through vapor line 24E and opening 80 into fourth chamber 46 of fuel vapor control valve 20. The air and fuel vapor mixture next leaves fourth chamber 46 through opening 82 and passes through vapor line 24F into carbon canister 16. Carbon canister 16 removes the remaining fuel vapor from the air and fuel vapor mixture, leaving essentially pure air. This air then leaves carbon canister 16 and enters third chamber 44 of fuel vapor control valve 20 via vapor line 24G and opening 78. The air then exits fuel vapor control valve 20 to atmosphere through check valve 54.

One can see from the foregoing description of the air and fuel vapor flow path that carbon canisters 16 and 18 are loaded in series with the air and fuel vapor mixture from fuel tank 10. That is, the air and fuel vapor mixture flows sequentially through carbon canisters 16 and 18. Such a series loading of carbon canisters 16 and 18 results in their having high efficiency in capturing and storing the fuel vapor from fuel tank 10.

Figure 3:
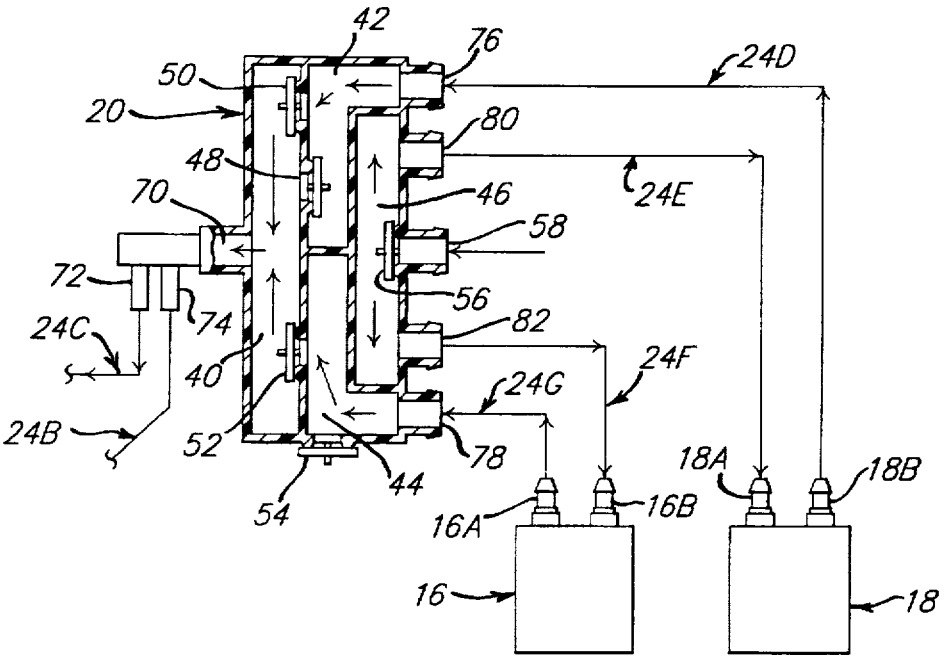
FIG. 3 illustrates the flow of air and fuel vapor while canisters 16 and 18 are purged.

Refer now to FIGS. 1 and 3. FIG. 3 illustrates the path followed by air and fuel vapor when carbon canisters 16 and 18 are purged. This purging occurs when the engine controller causes purge control valve 22 to open. In this case, port 72 of fuel vapor control valve 20 is exposed to vacuum at the air intake to engine 14. First chamber 40 therefore has a negative pressure with respect to second chamber 42 and third chamber 44. Check valves 50 and 52 can thus open. Further, due to the connections between second chamber 42 and carbon canister 18 and between third chamber 44 and carbon canister 16, fourth chamber 46 develops a negative pressure with respect to the atmospheric pressure external to fuel vapor control valve 20. Thus, check valve 56 can open. Consequently, the fuel vapor stored in carbon canister 18 is purged by air drawn into opening 58, past check valve 56, out of opening 80, through vapor line 24E, through carbon canister 18, through vapor line 24D, into opening 76, through check valve 50, and out port 72 to the air intake of engine 14. In a similar manner, the fuel vapor stored in carbon canister 16 is purged by air drawn into opening 58, past check valve 56, out of opening 82, through vapor line 24F, through carbon canister 16, through vapor line 24G, into opening 78, through check valve 52, and out port 72 to the air intake of engine 14.

The foregoing description of the purging of carbon canisters 16 and 18 shows that they are purged in parallel. That is, the purging air which is drawn in through opening 58 of fuel vapor control valve 20 is divided between carbon canisters 16 and 18, rather than sequentially flowing through them. This results in a less-impeded flow of purging air and purged fuel vapor than if canisters 16 and 18 were purged in series. Thus, less vacuum in fuel tank 10 is developed during the purging process.

Various other modifications and variations will no doubt occur to those skilled in the arts to which this invention pertains. Such variations which generally rely on the teachings through which this disclosure has advanced the art are properly considered within the scope of this invention. This disclosure should thus be considered illustrative, not limiting; the scope of the invention is instead defined by the following claims.

What is claimed is:

1. A fuel vapor control valve assembly comprising:

a first chamber having a first opening to the exterior of said valve assembly;

a second chamber having a second opening to the exterior of said valve assembly;

a third chamber having a third opening to the exterior of said valve assembly;

a fourth chamber having at least a fourth opening to the exterior of said valve assembly;

a first one-way valve, said first one-way valve disposed between said first and second chambers and oriented to allow vapor flow from said first chamber to said second chamber but not from said second chamber to said first chamber;

a second one-way valve, said second one-way valve disposed between said first and second chambers and oriented to allow vapor flow from said second chamber to said first chamber but not from said first chamber to said second chamber;

a third one-way valve, said third one-way valve disposed between said first and third chambers and oriented to allow vapor flow from said third chamber to said first chamber but not from said first chamber to said third chamber;

a fourth one-way valve, said fourth one-way valve disposed between said third chamber and the exterior of said valve assembly and oriented to allow vapor flow from said third chamber to the exterior of said valve assembly but not from the exterior of said valve assembly to said third chamber; and a fifth one-way valve, said fifth one-way valve disposed between said fourth chamber and the exterior of said valve assembly and oriented to allow vapor flow from said exterior of said valve assembly to said fourth chamber but not from said fourth chamber to said exterior of said valve assembly.

2. A valve assembly as recited in claim 1, wherein said first, second, third, fourth and fifth one-way valves are actuated by pressure differentials across said valves.

3. A valve assembly as recited in claim 1, wherein said first, second, third and at least fourth openings are continually open.

4. A fuel vapor control system comprising:

(a) a first fuel-vapor-capturing canister having first and second ports;

(b) a second fuel-vapor-capturing canister having third and fourth ports;

(c) a vapor control valve further comprising:

first, second, third and fourth chambers;

a first one-way valve, said first one-way valve disposed between said first and second chambers and oriented to allow vapor flow from said first chamber to said second chamber but not from said second chamber to said first chamber;

a second one-way valve, said second one-way valve disposed between said first and second chambers and oriented to allow vapor flow from said second chamber to said first chamber but not from said first chamber to said second chamber;

a third one-way valve, said third one-way valve disposed between said first and third chambers and oriented to allow vapor flow from said third chamber to said first chamber but not from said first chamber to said third chamber;

a fourth one-way valve, said fourth one-way valve disposed between said third chamber and the exterior of said valve assembly and oriented to allow vapor flow from said third chamber to the exterior of said valve assembly but not from the exterior of said valve assembly to said third chamber; and a fifth one-way valve, said fifth one-way valve disposed between said fourth chamber and the exterior of said valve assembly and oriented to allow vapor flow from said exterior of said valve assembly to said fourth chamber but not from said fourth chamber to said exterior of said valve assembly;

(d) a fuel tank having an interior volume, said interior volume fluidically coupled to said first chamber;

(e) a vacuum source; and (f) a purge valve fluidically coupled between said first chamber and said vacuum source; wherein said second chamber is fluidically coupled to said first port of said first fuel-vapor-capturing canister;

said third chamber is fluidically coupled to said first port of said second fuel-vapor-capturing canister;

said fourth chamber is fluidically coupled to said second port of said first fuel-vapor-capturing canister and to said second port of said second fuel-vapor-capturing canister.

5. A fuel vapor control system as recited in claim 4, wherein said vacuum source is an air intake of a vehicle engine.

* * * * *